US005184941A

United States Patent [19]

King et al.

[11] Patent Number: 5,184,941

[45] Date of Patent: Feb. 9, 1993

[54] MOUNTING SUPPORT FOR MOTOR-PUMP UNIT

[75] Inventors: James L. King; Richard E. Peters, both of Troy, Ohio

[73] Assignee: A. O. Smith Corporation, Wilmington, Del.

[21] Appl. No.: 683,225

[22] Filed: Apr. 10, 1991

[51] Int. Cl.[5] ..... F04B 35/04

[52] U.S. Cl. ..... 417/360; 417/363; 248/674; 310/89; 310/91; 415/213.1

[58] Field of Search ..... 417/360, 361, 363, 423.14, 417/423.15; 415/213.1; 248/674; 310/89, 91

[56] References Cited

U.S. PATENT DOCUMENTS

| | | | |
|---|---|---|---|
| 3,604,820 | 9/1971 | Scheiler | 417/363 |
| 3,687,576 | 8/1972 | Wikholm et al. | 417/424 |
| 3,743,447 | 7/1973 | Lynch | 417/360 |
| 4,211,519 | 7/1980 | Hogan | 417/360 |
| 4,601,378 | 7/1986 | Pierce et al. | 417/360 |
| 4,988,069 | 1/1991 | D'Silva | 417/363 |
| 5,006,743 | 4/1991 | King et al. | 310/89 |

*Primary Examiner*—Richard A. Bertsch

*Assistant Examiner*—Charles G. Freay

*Attorney, Agent, or Firm*—Eugene R. Sawall; James Earl Lowe, Jr.

[57] ABSTRACT

A motor-pump unit includes a first mounting leg member at the interconnection of the motor and the pump and an outer multiple releasable outer mounting leg member at the outer end of the motor. The releasable leg member permits mounting with spaced supports under the motor or by removing of the outer leg cantilevered motor. The first leg member has a U-shaped base secured to the pump and extended beneath the motor frame adjacent the pump with circumferential spaced depending legs. An extended outer frame of the motor frame has an end notch in the bottom wall portion and the outer leg member has a mounting plate with an edge recess telescoped into the edge of the notch. An end cap has a projection extended into the opposed recess in the plate. The outer leg member has a single depending leg to define a three point mounting of the motor-pump unit. The outer leg member is removed for a cantilevered support and a closure plate is clamped into the notch to close the opening. The outer leg member is also shown bolted to the outer end of the motor.

16 Claims, 1 Drawing Sheet

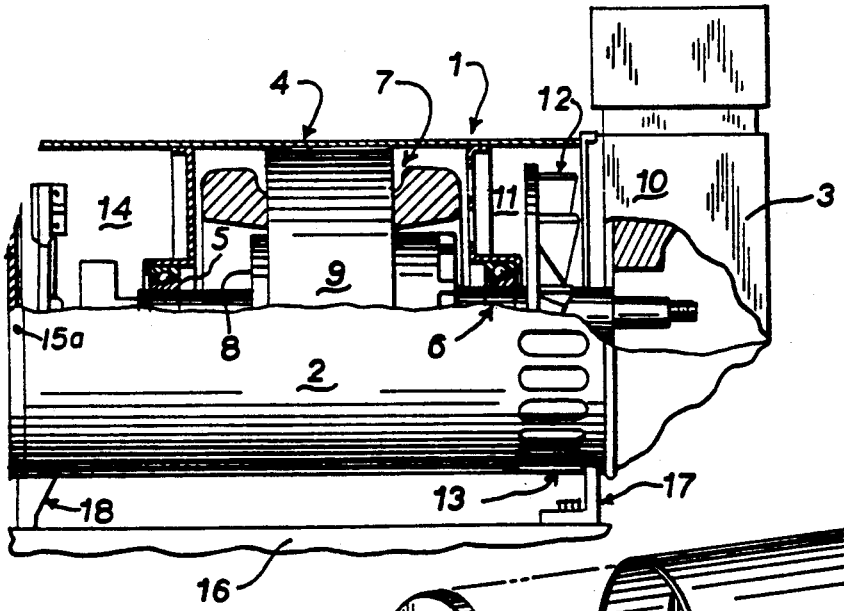
FIG. 1
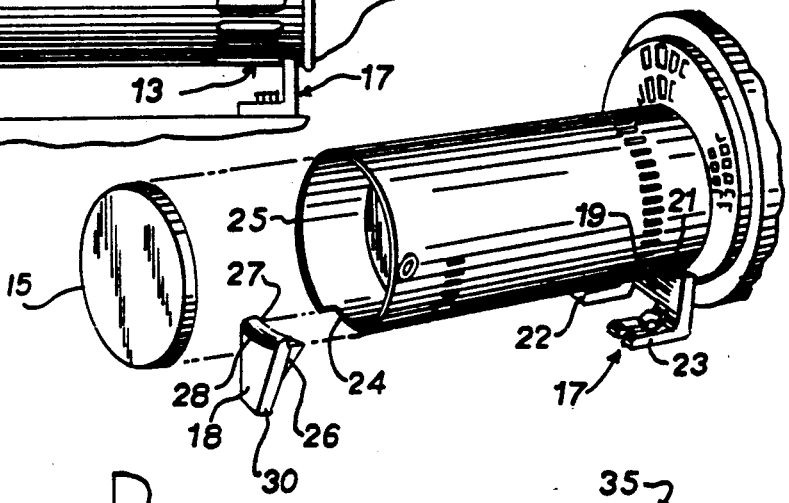
FIG. 2
FIG. 3
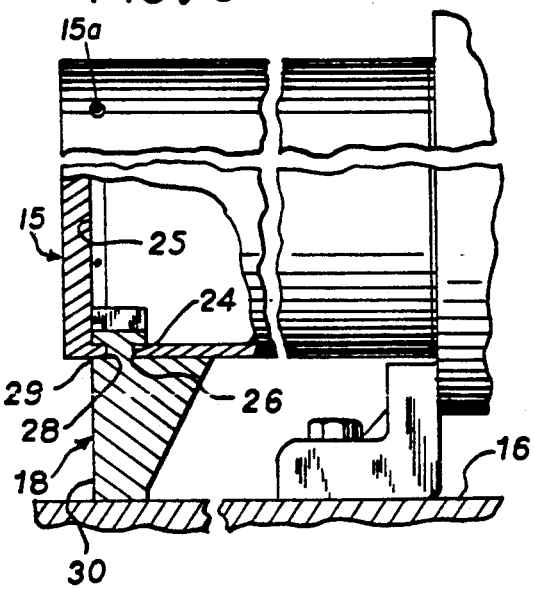
FIG. 5
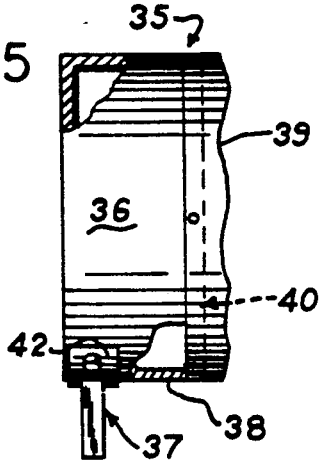
FIG. 6
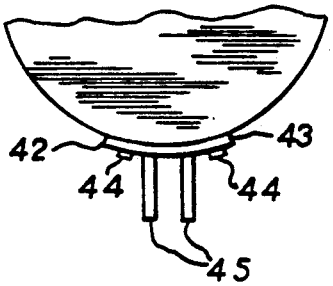
FIG. 4
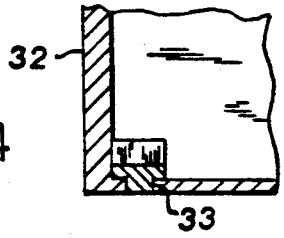

MOUNTING SUPPORT FOR MOTOR-PUMP UNIT

BACKGROUND OF THE PRESENT INVENTION

This invention relates to a mounting support for a motor-pump unit having a pump secured to one end of the motor frame and forming an integrated motor-pump unit with a common base mounting support.

Rotary electric motors are widely used for direct driving of a pump unit in various applications such as residential water baths including pools, spas, whirlpools and the like. A fractional horsepower rotary motor includes a cylindrical main frame within which the motor structure is securely mounted. The motor shaft projects from one end and is direct coupled to a pump impeller of a pump unit. The pump unit includes a housing structure which is interconnected to the motor frame. In a standard construction of a rotary motor, a pump housing includes a cylindrical portion which is telescoped with the motor frame and interconnected thereto to form a drip chamber between the motor and the pump unit. A motor mounting base or cradle is secured to the pump unit and extendes beneath the motor frame for mounting of the motor and pump unit on a suitable support. The cradle member has suitable feet members for engaging a support wall or floor and secures the motor in place. A particularly satifactory motor structure incorporating an extended frame structure and providing a drip chamber to one end of the motor frame and a control chamber to the opposite end is shown in the co-pending application of King et al entitled "Multiple Compartmented Dynamoelectric Machine" and filed on Oct. 26, 1989, now U.S. Pat. No. 5,006,743. A typical cradle structure is shown secured to the pump housing and extended to the underside of the motor frame and provides for support of the integrated motor-pump unit. Alternately, the motor is cantilevered to the pump housing by providing a sufficiently heavy and strong impeller housing bracket to which the motor frame is properly connected to support the motor.

Although the prior art provides a satisfactory support system, there are installations where the supporting structure must be specially rearranged to accommodate the motor base support or other special supports provided. In certain applications, a simple mounting of the pump unit with the motor cantilevered therefrom would be desired and acceptable. The standard method of mounting the motors however may not be conveniently adapted to these various special requirements. Further, the motor supporting structure is relatively heavy and costly to fabricate and assemble and contribute to the cost of the motor-pump. A more versatile and less costly supporting structure would of course be advantageous to commercialization in the highly competitive market for motor-pump units.

SUMMARY OF THE PRESENT INVENTION

The present invention is particularly directed to a multiple part support including a inner mount structure adapted to be secured and formed as a part of the motor-pump unit at the interconnection of a motor unit and a pump unit in combination with an outer releasable mount to provide a multiple support for an integrated motor-pump unit. The releasable outer mount is in a particularly useful embodiment of the invention. A releasable leg member permits the mounting of the assembly in a more or less conventional supporting arrangement as well as permitting the direct mounting of the motor unit at common abutting end of the motor unit and pump unit with the motor supported as a cantilevered member. The mount elements for the present invention are readily constructed at minimal cost and thus provide a less costly and more versatile mounting assembly for an integrated motor-pump unit.

More particularly, in a particularly practical embodiment of the invention, the motor structure is constructed in accordance with the teaching of the previously identified co-pending application of King et al. The forward mount structure is generally an U-shaped or saddle member having a base structure adapted to mate with the portion of the motor frame immediately adjacent the pump and having a depending leg structure for resting on a suitable and releasable securement to a support such as the floor or horizontal support plate. The outer cantilevered end of the motor frame is constructed to receive the detachable support leg member, which may be formed integral with the motor end closure or cup, or in a preferred construction as a separate leg member releasably coupled to the motor frame or to the cap. A releasable connection directly to the motor frame housing or frame is preferred to allow removal of the end cap without disturbing the motor support. In a unique and preferred structure, the extended frame of the motor frame has an edge notch in the bottom wall portion of the extended main motor frame. A single leg member is provided having a mounting base adapted to telescope into coupling relation with the edge of the frame notch and with suitable overlapping support surfaces to close the notch and provide a firm supporting interconnection between the leg member and the frame. The leg member includes a depending portion to support the motor in a common plane with the leg structure of the forward support unit to define a three point mounting of the motor-pump unit. The outer leg member is locked in place by the attachment of an outer compartment closure unit cap. The cap seals the compartment and simultaneously locks the leg in position. In those installations in which the leg member is eliminated, a simple closure plate is provided and clamped into sealing arrangement within the opening to maintain the closure of the auxiliary compartment.

The present invention thus provides a very versatile and less costly motor-pump construction which can be readily fabricated using present day technology and materials and providing an improved system for supporting of the integrated motor-pump in various installations and applications while maintaining a pleasing esthetic presentation and mounting. The three leg support of the present invention also provides an improved support particularly on a rough surface where the three legs rest more securely in place.

DESCRIPTION OF THE DRAWING

The drawing furnished herewith illustrates the best mode presently contemplated for carrying out the invention and is described hereinafter.

In the drawing:

FIG. 1 is a side elevational view of a motor-pump unit illustrating a motor support construction in accordance with the teaching of the present invention;

FIG. 2 is an exploded pictorial view of the structure illustrated in FIG. 1;

FIG. 3 is a fragmentary and enlarged longitudinal section illustrating the mounting support for the motor-pump assembly shown in FIGS. 1 and 2;

FIG. 4 is a fragmentary side view similar to FIG. 3, with parts broken away and sectioned, and illustrating a modification of the support structure shown in FIG. 1;

FIG. 5 is a fragmentary view similar to FIG. 3 illustrating an alternate support of the motor shown in FIG. 1; and FIG. 6 is an end view of FIG. 5.

DESCRIPTION OF THE ILLUSTRATED EMBODIMENT

Referring to the drawings and particularly to FIGS. 1 and 2, a motor-pump unit 1 is illustrated including a fractional horsepower motor 2 having a integrated pump 3 secured to the one end of the motor. In the illustrated embodiment of the invention, the motor 2 is constructed in a preferred construction as more fully disclosed in the previously identified co-pending King et al application. Thus, the motor 2 includes a cylindrical outer main frame 4 within which suitable end bearings 5 and 6 are secured to define a motor compartment 7 for supporting a rotor unit 8 concentrically rotatably mounted within a stator unit 9. The frame 4 projects axially as a continuous member from the opposite end of the motor compartment 7 defined by the bearing members. The pump 3 has an outer housing 10 directly affixed to the one end of the extended motor main frame and defines a fan and drip compartment 11 between the internal end bearing member 6 and the pump 3. The drip chamber 11, as illustrated, includes a fan 12 and openings 13 in the frame 4. The fan 12 provides cooling air flow through the motor 2 while the openings provide for exit of the air as well as exit of any water which leaks from the pump into the compartment 11.

The opposite end of the motor 2 includes the extended frame 4 defining a power equipment and control chamber or compartment 14 within which the necessary controls and power connections and equipment are located. The outer end of the compartment frame is closed by a suitable end cap 15 is secured in place by suitable screws 15*a* or other suitable devices, and which serves to essentially seal the compartment 14 from the surrounding environment, as more fully described in the above identified application. The motor-pump unit 1 is adapted to be supported on a suitable support floor or plate 16. In the illustrated embodiment, a three point support assembly includes a first leg member 17 secured to the motor-pump junction or interconnection and a second or outer leg member 18 secured to the motor 2 at the outer cantilevered end and particularly at the control compartment 14.

The present invention is particularly directed to the motor support assembly and structure and is shown applied in a preferred motor-pump construction. The support assembly can be applied to any other suitable motor-pump unit and thus the other components of the motor-pump unit are only described in such detail as necessary to clearly disclose and explain the illustrated embodiment of the invention and its application in its construction in accordance with the teaching of the present invention.

Referring particularly to FIGS. 2 and 3, the first leg member 17 is shown as a single integral saddle structure or unit having a generally U-shaped base 19 which is secured to the pump housing by spaced attachment bolts (not shown). The leg member 17 may be integrally molded or cast with housing or otherwise attached. The interface 21 between the saddle base 19 and the frame 4 complement each other with the saddle base extending throughout approximately ninety degrees of the motor frame 4. A pair of L-shaped legs 22 and 23 are integrally formed to one base 19 and depend downwardly from the appropriate ends of the base and define a two-point support for the forward end of the integrated motor-pump unit. A single common leg may be formed spanning the central portion of the base. The leg member 17 has a short axial length along the motor frame 4 and terminating beneath the compartment 11, the motor compartment 7 and the control compartment 14 extended therefrom. The leg member 17 is thus a relatively axially narrow or short member fitting well between the drip openings and the outer end of the frame structure.

The outer or second leg member 18 is shown as a single depending leg member which is releasably secured within an outer end opening shown as an edge notch 24 in the axial end edge 25 of the compartment 14 of frame 4. As more clearly shown in FIGS. 2 and 3, the notch 24 in the end edge of the power equipment and control compartment is formed as a rectangular notch 24 having a circumferential length of approximately thirty degrees. The illustrated axial length of the notch is approximately one fifth the depth of the illustrated compartment. The circumferential length and the axial depth will of course be constructed in accordance with the particular weight and application of the motor-pump unit 1 to provide the necessary structural support while maintaining an appropriate esthetic pleasing presentation.

The outer leg member 18 includes a mounting base 26 having a curved rectangular configuration. The curvature of base 26 complementes the frame at the rectangular notch 24. The outer peripheral edge 27 of the mounting base 26 is somewhat larger than the notch 24 to close the notch in the attached position, as follows. The edge is also preferably formed to overlap with the frame 4 to form a continous exterior surface. Thus, the outer edge is shown with an encircling slot or recess 28 and defining a complementing recess essentially complementing the edge configuration of the notch 24. The base 26 is telescoped into engagement with the edge of the notch 24 and provides a direct interlock between the leg member 18 and the frame 4, as most clearly shown in FIGS. 2 and 3. The outer end closure cap 15 is releasably secured to and within the frame 4. The cap 15 includes an edge lip 29 which projects into the frame 4, with the portion aligned with slot or notch 24 offset to the plane of frame 4 so as to project into the aligned recess 28 of the leg base 26. The cap 15 is thus interconnected to the axially outer edge of the leg base 26 and in combination with the inner telescoped recessed overlapping portions securely clamps the leg member in supporting relationship with the motor frame 4 to establish a reliable physical interconnection therebetween. A depending leg 30 integral with base 26 projects downwardly from the base 26 with the outer end thereof located in proper relationship with the ends of the two legs 22 and 23 of the forward saddle mount or leg member 17 to appropriately locate and support the motor-pump unit 1 with a three point on the plate or wall 16.

In various applications, the motor-pump unit 1 may be interconnected to a separate support or the motor projects in a location with the outer support can not be used or is desired. The motor support is thus limited to a forward pump which must be such as to carry the cantilevered motor. In such structures, the outer outer leg member 18 is not a necessary element, and in fact, may not be used. In the present invention, the releasable outer leg member can be readily and rapidly removed in any installation or provided as required depending upon the original or subsequent installation and fabrication.

Where the leg member 18 is removed, the notch 24 or other opening is preferably close by a suitable closure plate 32 inserted in the notch, such as shown in FIG. 4. The illustrated cover plate 32 is a curved metal plate conforming to that of the frame 4 and having a surface projection 33 complementing that of the notch 24 in the compartment 14. The closure plate edge 33 may thus be the same as the mounting edge of the leg member 18 and the plate is clamped in position by the end closure cap 15 in essentially the manner of securing the leg member 18.

Although shown as applied to the integrated motor frame structure, the present invention can be equally applied to other motor structures. Further, the outer leg unit can be otherwise releasably attached to the motor frame. For example, with the broadest aspect of the invention, the outer leg unit may be formed as an integral part of the end cap or motor closure to provide a simple leg structure for connection to the motor frame, or otherwise formed as a separate leg member for releasable securement to the motor end structure. The construction which permits removable of an outer end closure or cap without removable of the outer leg unit is preferred because removable of the cap does not then interfere with the support of the motor-pump unit.

For example, a motor-pump unit 35 having a separate end compartment wall unit 36 is shown in FIGS. 5 and 6. The compartment construction is more fully disclosed and described in the application of James L. King et al entitled "Multiple Compartmented Dynamoelectric Machine" and filed Oct. 26, 1989 which is readily constructed secured thereto with a releasable leg member 37. The wall unit 36 is generally a dish-shaped drawn or molded member having a cylindrical wall 38 complementing the motor frame 39 adjacent a bearing member 40. The wall 38 is secured to the frame 39 and projects outwardly to an integral end closure wall 41. Rather than the integral wall 41, the wall may be formed as a separate member and secured to the end of cylindrical wall 38, for example, as shown in the first embodiment. The outer leg member 37 forming the outer support structure is secured to the bottom wall portion of the cylindrical wall 38.

The outer leg member 37 can of course be mounted in any suitable manner in addition to the preferred construction illustrated in FIGS. 1–4. The leg member 37 is shown with a curved based 41 having circumferential edge flanges 42 and 43 bolted to the motor frame 39 in the embodiment of FIG. 5, as by bolts 44. The base 41 spans on an appropriate portion of the compartment wall 38 to firmly support the motor, and is also shown with spaced legs 45 for purposes of illustrating a four point support system.

The present invention thus provides a simple, cost effective and commercially practical multiple part mount for a motor-pump unit and the like and is particularly adapted to incorporation into the integrated motor structure having the outer extended power equipment and control chamber.

Various modes of carrying out the invention are contemplated as being within the scope of the following claims and particularly pointing out and distinctly claiming the subject matter as the invention.

We claim:

1. A motor-pump unit comprising a cylindrical motor unit having an outer main motor frame of an essentially constant diameter, a pump unit secured to one end of said frame, a first mount secured to the motor-pump unit at the interconnection between the motor unit and the pump unit, said mount including a depending support for firmly supporting the motor-pump unit resting on a support surface, and a separate mount spaced from said first mount and secured to the outer cantilevered end of said motor, said separate mount with said first mount defining spaced supports of said motor-pump unit on said support surface, and a releasable connection between said motor frame and said separate mount for selectively mounting said motor as a multiple supported unit or as a cantilevered motor unit.

2. The motor-pump unit of claim 1, wherein said first mount includes support areas located to the opposite side of a vertical plane through the motor-pump unit, and said separate mount includes a single support area substantially in said vertical plane to define a three point support of said unit.

3. The motor-pump unit of claim 1, wherein said pump unit includes an outer housing having a round portion telescoped to said main motor frame and connected thereto and defining a drip chamber between said motor unit and pump unit, said first mount being connected to said pump housing and having a base saddle extending beneath the bottom of said motor frame and having depending first and second leg members secured to the opposite side portions of said base saddle, and said separate mount having a base releasably secured to said frame and a depending leg located centrally between said first and second leg member.

4. The motor-pump unit of claim 1, wherein said frame is a single integral member having a control compartment extending from an end bearing within said frame and terminating in an outer edge, a closure cap releasably secured to said outer edge to close said control compartment, said edge having an edge notch the central bottom portion of said control compartment, said separate mount having a mounting plate with a curvature complementing the curvature of said frame at said notch, said plate being secured within said notch and said cap engaging said plate to releasably clamp said plate within said notch.

5. The motor-pump unit of claim 4, wherein said mounting plate is larger than and overlaps the edges of said notch, said notch projecting partially through said control compartment, said mounting plate having an encircling recess complementing the edge of said edge notch and an outer recess portion, said closure cap having a corresponding projection whereby securement of said cap locks said projection into the recess and secures the mounting plate within said notch.

6. A motor-pump unit comprising a cylindrical motor unit having an outer main motor frame of an essentially constant diameter, a pump unit secured to one end of said frame, a first motor mount secured to the motor-pump unit at the interconnection between the motor unit and the pump unit, said mount including a depending support defining at least two laterally spaced support areas, and a single mount secured to the outer cantilevered end of said motor frame, said single mount with said first motor mount defining an essentially three point support of said motor-pump unit, and a releasable connection between said motor frame and said single mount.

7. The motor-pump unit of claim 6, wherein said first mount includes support areas located to the opposite side of a vertical plane through the motor-pump unit, and said single mount includes a single support area substantially in said vertical plane.

8. The motor-pump unit of claim 6, wherein said first mount includes a base saddle including an integral curved base wall complementing the under surface of said motor frame and extending throughout substantially a minimum of ninety degrees of the motor frame circumference, said forward mount including laterally spaced legs depending downwardly from said curved saddle member and defining a two point support for the forward end of said motor.

9. The motor-pump unit of claim 8, wherein said single mount includes a support base extending circumferentially of the frame, said releasable connection including means securing said base to said frame, and said single mount having a single leg member projecting downwardly from said support base.

10. The motor-pump unit of claim 6, wherein said pump unit includes an outer housing having a round portion telescoped to said main motor frame and connected thereto and defining a drip chamber between said motor unit and pump unit, said first mount being integrally connected to said pump housing and having a base saddle extending beneath the bottom of said motor frame, and having depending first and second leg members secured to the opposite side portions of said base saddle, and said single mount having a base

11. The motor-pump unit of claim 6, wherein said frame is a single integral member having a control compartment extending from an end bearing within said frame and terminating in an outer edge, a closure cap releasably secured to said outer edge to close said control compartment, said edge having an edge notch in the central bottom portion of said control compartment, said single mount having a mount plate with a curvature complementing the curvature of said frame at said notch, said plate having an inner edge portion engaging the inner edge of said notch and said cap abutting the outer end of said plate to releasably clamp said plate within said notch.

12. The motor-pump unit of claim 11, wherein said notch is a rectangular notch projecting partially through said control compartment and having parallel side edges parallel to the axis of said frame, said mount plate having an encircling recess complementing the edges of said edge notch and an outer recess portion aligned with a corresponding projection on said closure cap whereby securement of said cap secures the mount plate within said notch.

13. The motor-pump unit claim 6, wherein said single mount is bolted to the outer end of said frame.

14. The motor-pump unit of claim 6, wherein the outer end of said motor includes a control compartment housing with a cylindrical wall complementing and secured to said motor frame, and said single mount being releasably secured to said cylindrical wall.

15. A motor-pump unit including a pump having a housing with a round mounting pump frame, a motor having a complementing round motor frame secured to said pump frame and projecting outwardly thereof, and end bearings within said motor frame and defining a motor compartment, forward mount structure including a U-shaped base complementing motor frame immediately adjacent the pump, depending legs depending from said base to the opposite sides of the motor, said motor having an outer end frame member projecting outwardly of the end bearigns, a notch in a bottom wall portion of the outer end frame member, a leg member having a mounting plate located in overlapping relation to said notch and closing the notch, a releasable connection between the plate and the outer end frame member establishing a firm supporting interconnection between the leg member and the outer end frame member.

16. The motor-pump unit of claim 15, wherein said notch is a rectangular notch formed in an outer end edge of said outer end frame member, said plate and end edge having interlocking telescoped members, and an end cap is secured to said outer end frame member, and clamps said plate to said outer end frame member.

* * * * *